US012760977B2

(12) United States Patent
Dueck et al.

(10) Patent No.: US 12,760,977 B2
(45) Date of Patent: Oct. 13, 2026

(54) ADJUSTABLE GAS REGULATOR VALVE FOR DIRECT GAS OPERATED FIREARMS

(71) Applicant: SureFire, LLC, Fountain Valley, CA (US)

(72) Inventors: Barry William Dueck, Fountain Valley, CA (US); Michael Standen, Fountain Valley, CA (US); Eric Hung Leung Chow, Fountain Valley, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 17/730,612

(22) Filed: Apr. 27, 2022

(65) Prior Publication Data

US 2023/0349651 A1 Nov. 2, 2023

(51) Int. Cl.
*F41A 5/28* (2006.01)

(52) U.S. Cl.
CPC ..... *F41A 5/28* (2013.01)

(58) Field of Classification Search
CPC ..... F41A 5/24; F41A 5/26; F41A 5/28; F41A 5/18–28; A61K 3/00–36
USPC ..... 138/46
See application file for complete search history.

(56) References Cited

U.S. PATENT DOCUMENTS 2,149,512 A * 3/1939 Halvor ..... F41A 5/26 89/193
3,217,735 A * 11/1965 Stalter ..... F16K 3/28 251/266
8,316,756 B1 * 11/2012 Woodell ..... F41A 5/28 89/193
9,291,415 B1 * 3/2016 Beaty ..... F41A 5/28
2006/0065112 A1 * 3/2006 Kuczynko ..... F41A 5/28 89/193
2009/0229454 A1 * 9/2009 Fluhr ..... F41A 5/26 89/193
2013/0098235 A1 * 4/2013 Reinken ..... F41A 5/28 89/193
2016/0033218 A1 * 2/2016 Folkestad, II ..... F41A 3/66 42/2
2016/0047614 A1 * 2/2016 Larson, Jr. ..... F41G 11/003 89/191.01
2020/0363148 A1 * 11/2020 Sylvester ..... F41A 3/26

* cited by examiner

*Primary Examiner* — Gabriel J. Klein
(74) *Attorney, Agent, or Firm* — Rutan & Tucker LLP; Hani Z. Sayed

(57) ABSTRACT

An apparatus and methods are provided for a gas regulator valve for adjusting cycle speeds of direct gas impingement operated firearms. The gas regulator valve comprises a gas inlet for receiving expanding gases from a fired cartridge and a gas tube for directing the expanding gases to a bolt carrier comprising a firearm. The gas inlet is disposed at the front of an upper receiver comprising the firearm. The gas tube directs the expanding gases into a carrier key of the bolt carrier. The gas regulator valve includes a plug for controlling gas flow through the gas tube. An actuator disposed on a side of the upper receiver enables operating the plug. The actuator enables a practitioner to adjust the flow of expanding gases without moving the firearm out of a shooting position. The actuator includes a key that may be turned by a rim of an ammunition cartridge.

13 Claims, 7 Drawing Sheets

ADJUSTABLE GAS REGULATOR VALVE FOR DIRECT GAS OPERATED FIREARMS

FIELD

Embodiments of the present disclosure generally relate to firearms. More specifically, embodiments of the disclosure relate to an apparatus and methods for an adjustable gas regulator valve for tuning an amount of gas directed to a bolt carrier of a direct gas operated firearm.

BACKGROUND

The AR15/M4/M16 family of firearms and their derivatives, including all direct gas operated versions, have been in use by the military and civilian population for many years. An essential component of direct gas operated firearms is the bolt carrier group. Typically, the bolt carrier group includes a bolt mounted in a bolt carrier that is configured for axial sliding movement and rotation within a firearm. The bolt carrier group further includes a cam-pin that controls rotation between the bolt and the bolt carrier.

The bolt carrier group generally is configured for stripping or picking up ammunition cartridges from a magazine and moving the cartridges into a battery position within a breech of the firearm. After firing each round, the bolt carrier group extracts and ejects the ammunition cartridge through an ejection port on a side of the firearm. The energy to perform these functions is provided by way of hot, expanding gases from the fired cartridge that are directed through a port closer to the end of the barrel and channeled back to the bolt carrier group. The expanding gases strike, or impinge, the bolt carrier moving it rearward toward the buttstock and into a retracted position. The exhaust gases are then discharged through the ejection port on the side of the firearm. After discharge, a spring acting on the bolt carrier group moves the bolt carrier back to an engaged position while at the same time stripping another cartridge from the magazine and moving that cartridge into the battery position.

A drawback to direct gas operated firearms is that it can be difficult to adjust the amount of gas that is directed to the bolt carrier. For example, different makes and types of ammunition produce differing amounts of gas, thereby giving rise to different levels of force on the bolt carrier. Thus, a rifle that is tuned to fire a certain ammunition may not operate as well when firing a different ammunition. Too much gas being directed to the bolt carrier can damage the firearm, as well as being potentially dangerous to a practitioner, such as a shooter firing the firearm. For example, a greater amount of gas impinging on the bolt carrier causes the cycle speed of the firearm to increase, which can result in feed jams, extraction failures, carrier bounce, and the like. As such, misfires can occur and become more frequent until the rifle becomes inoperable due to excessive wear and/or broken parts.

In an attempt to enable adjusting the amount of gas recirculated to the bolt carrier, an adjustable valve may be incorporated into a front sight base or gas block of the firearm. A drawback to such a valve, however, is that such close proximity to the gas port can subject the valve to the damaging effects of heat and soot. Another drawback to incorporating the valve into the front sight base is that the shooter must move the firearm out of a shooting position into an upright position to access the valve.

There is a need, therefore, for an apparatus and methods for tuning the amount of gas directed to the bolt carrier of a direct gas operated firearm that overcomes the above-described drawbacks and limitations.

SUMMARY

An apparatus and methods are provided for a gas regulator valve for adjusting cycle speeds of direct gas impingement operated firearms. The gas regulator valve comprises a gas inlet for receiving expanding gases from a fired cartridge and a gas tube for directing the expanding gases to a bolt carrier comprising a firearm. The gas inlet is disposed at the front of an upper receiver comprising the firearm. The gas tube is configured to direct the expanding gases into a carrier key of the bolt carrier. The gas regulator valve includes a plug for controlling gas flow through the gas tube. An actuator disposed on a side of the upper receiver enables operating the plug. The actuator enables a practitioner to adjust the flow of expanding gases without having to move the firearm out of a shooting position. The actuator includes a key that may be engaged and turned by a rim of an ammunition cartridge.

In an exemplary embodiment, a gas regulator valve for adjusting cycle speed of a bolt carrier of a firearm comprises: a valve body for providing a gas inlet; a gas tube for receiving a carrier key of the bolt carrier; a plug for controlling gas flow through the gas tube; and an actuator for altering the position of the plug.

In another exemplary embodiment, the gas inlet is disposed in a distal end of the valve body and is configured to receive a gas tube comprising the firearm. In another exemplary embodiment, the plug is disposed between the gas inlet and a gas outlet comprising the gas tube. In another exemplary embodiment, the gas flow may be controlled by turning the actuator to alter the position of the plug within the valve body.

In another exemplary embodiment, the plug comprises a hollow member having a threaded hole that opens at one end and extends through the plug to a closed end. In another exemplary embodiment, the threaded hole receives a stem comprising the actuator while the closed end is configured to contact a seat inside the valve body. In another exemplary embodiment, the stem includes threads that are configured to helically engage within the threaded hole. In another exemplary embodiment, the threaded hole and the threads of the stem are configured to cooperate to cause the plug to move with respect to the seat when the actuator is turned. In another exemplary embodiment, the threaded hole and the threads of the stem are configured to advance the plug toward the seat when the actuator is turned in a clockwise direction. In another exemplary embodiment, the threaded hole and the threads of the stem are configured to advance the plug toward the seat when the actuator is turned counterclockwise.

In an exemplary embodiment, a gas regulator valve for adjusting cycle speed of a bolt carrier of a firearm comprises: a valve body for providing a gas inlet; a gas tube for receiving a carrier key of the bolt carrier; an actuator for directly controlling gas flow through the gas tube.

In another exemplary embodiment, the actuator is rotationally mounted within the valve body such that various degrees of actuator rotation correspond to various degrees of valve body occlusion. In another exemplary embodiment, the actuator comprises multiple ports of differing sizes such that the actuator can be rotationally positioned to direct gas flow through any one of the ports. In another exemplary embodiment, the actuator comprises multiple ports or slots such that the actuator can be rotationally positioned to direct gas flow through one or more of the ports or slots to produce corresponding, typically differing, degrees of valve body occlusion.

In another exemplary embodiment, the actuator comprises an eccentric element creating a gas channel of varying cross-sectional area such that differing rotational positions produce corresponding, typically differing, degrees of valve body occlusion. In another exemplary embodiment, the actuator comprises at least one port of varying cross-sectional area, such as a teardrop, so that rotational position produces corresponding, typically differing, degrees of valve body occlusion. In another exemplary embodiment, the actuator comprises at least one port or slot of sufficient cross-sectional area, such that depending upon rotational position, typically differing degrees of valve body occlusion occur as said port or slot is aligned or misaligned with ports or slots in the valve body.

In another exemplary embodiment, the valve body, inlet gas tube and outlet gas tube comprise a single component providing a gas inlet directly or indirectly receiving gas from the barrel, a valve assembly for controlling gas flow, and an outlet gas tube for receiving a carrier key of the bolt carrier.

In an exemplary embodiment, an upper receiver for a direct gas impingement operated firearm comprises: a gas inlet for receiving expanding gases from a fired cartridge; a gas tube for directing the expanding gases to a bolt carrier; and an actuator for controlling flow of the expanding gases to the bolt carrier.

In another exemplary embodiment, the gas inlet is disposed at the front of the upper receiver and is configured to receive the expanding gases by way of a front sight base and a gas tube comprising the firearm. In another exemplary embodiment, the gas tube is configured to receive a carrier key comprising the bolt carrier. In another exemplary embodiment, the actuator is positioned on the upper receiver to enable a practitioner to adjust the flow of expanding gases without moving the firearm out of a shooting position. In another exemplary embodiment, the actuator includes a key that is configured to receive a tool to enable rotation of the actuator. In another exemplary embodiment, the key is configured to receive the rim of an ammunition cartridge.

In an exemplary embodiment, a method for adjusting cycle speed of a bolt carrier of a firearm comprises: causing expanding gases to enter a gas inlet disposed at the front of an upper receiver; observing a first cycle speed of the bolt carrier; turning an actuator to control flow of the expanding gases to the bolt carrier; and observing a second cycle speed of the bolt carrier.

In another exemplary embodiment, causing expanding gases to enter the gas inlet includes discharging an ammunition cartridge. In another exemplary embodiment, turning the actuator includes engaging a tool with a key comprising the actuator without moving the firearm out of a shooting position. In another exemplary embodiment, engaging the tool comprises inserting a rim of an ammunition cartridge into the key and rotating the actuator.

In another exemplary embodiment, the actuator is vertically positioned on an upper receiver such that adjustment may be performed at the top of the upper receiver. In another exemplary embodiment, the actuator is horizontally positioned such that adjustments may be performed at the side of the upper receiver. In another exemplary embodiment, the actuator is positioned at an angle other than 90 degrees with respect to the top or the side of the upper receiver.

These and other features of the concepts provided herein may be better understood with reference to the drawings, description, and appended claims.

BRIEF DESCRIPTION OF THE DRAWINGS

The drawings refer to embodiments of the present disclosure in which.

Figure 1:
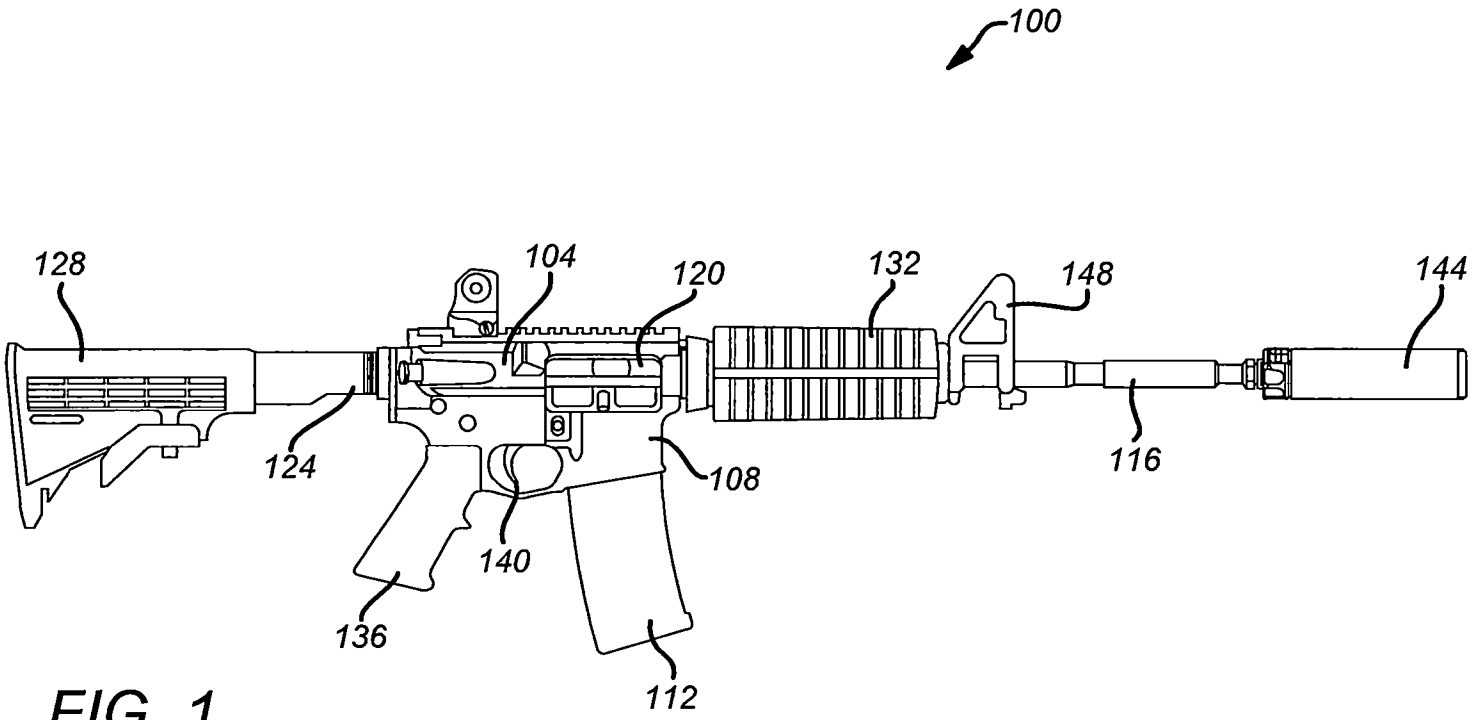
FIG. 1 illustrates a right-side elevation view of an exemplary embodiment of a firearm that utilizes direct gas impingement to operate a bolt carrier group comprising the firearm.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the adjustable gas regulator valve and methods disclosed herein may be practiced without these specific details. In other instances, specific numeric references such as "first screw," may be made. However, the specific numeric reference should not be interpreted as a literal sequential order but rather interpreted that the "first screw" is different than a "second screw." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

The AR15/M4/M16 family of firearms and their derivatives, including all direct gas operated versions, have been in use by the military and civilian population for many years. A drawback to direct gas operated firearms is that it can be difficult to adjust the amount of gas that is directed to the bolt carrier. Too much gas being directed to the bolt carrier can result in feed jams, extraction failures, carrier bounce, and misfires that become more frequent until the rifle becomes inoperable due to excessive wear and/or broken parts. Further, a drawback to incorporating an adjustment valve into a front sight base of the firearm is that a shooter must move the firearm out of a shooting position into an upright position to access the valve. Embodiments presented herein provide an adjustable gas regulator valve and methods for tuning the amount of gas directed to the bolt carrier of a direct gas operated firearm.

FIG. 1 illustrates a right-side elevation view of an exemplary embodiment of a firearm 100 that utilizes direct gas impingement to cycle the action of a bolt carrier group comprising the firearm, as described herein. In general, the firearm 100 comprises a member of the AR15/M4/M16 family of firearms, and thus the firearm 100 includes an upper receiver 104 that houses the bolt carrier group (not shown) and a lower receiver 108 that receives a magazine 112 containing a multiplicity of ammunition cartridges. The lower receiver 108 positions the ammunition cartridges within the upper receiver 104 such that the bolt carrier group may strip cartridges into a battery position within a breech of a barrel 116. An ejection port 120 on a side of the upper receiver 104 enables the bolt carrier group to eject spent ammunition cartridges after each round is fired. A buffer tube 124 coupled with a rear of the upper receiver 104 provides a housing for longitudinal movement of the bolt carrier group during stripping and ejecting ammunition cartridges. A buttstock 128, handguards 132, and a grip 136 facilitate a practitioner holding and supporting the firearm 100 during operating the firearm 100 by way of a trigger 140. Further, a suppressor 144 may be coupled with a muzzle end of the barrel 116 to reduce noise and muzzle flash during operating the firearm 100.

As described herein, the bolt carrier group moves longitudinally within the upper receiver 104 during stripping ammunition cartridges from the magazine 112, chambering the cartridges in the breech, and ejecting spent cartridges. The energy to perform these functions is provided by way of hot, expanding gases from each fired cartridge that cause the bolt carrier to move rearward within the buffer tube 124 toward the buttstock 128. The expanding gases are directed to the bolt carrier group from a port distal to the chamber and proximal to end of the barrel 116 by way of a front sight base 148 and a gas tube 172 (see FIG. 4) disposed within the handguards 132. The expanding gases cause the bolt carrier group to move rearward within the buffer tube 124 and then are discharged through the ejection port 120. After discharge, a spring acting on the bolt carrier group moves the bolt carrier forward to an engaged position while at the same time stripping another ammunition cartridge from the magazine 112 and moving that cartridge into the battery position.

Figure 2:
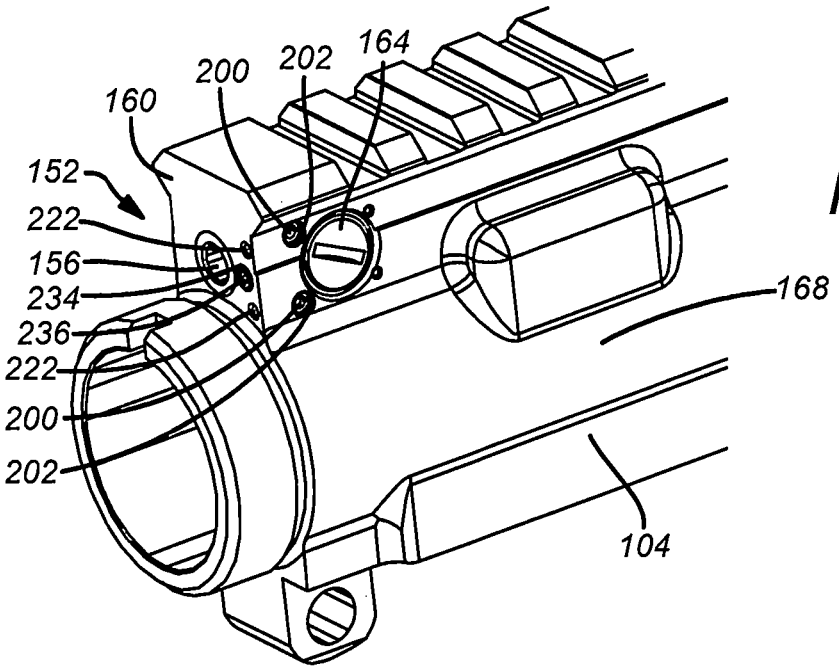
FIG. 2 illustrates an isometric view of a front portion of an exemplary embodiment of an upper receiver that includes a gas regulator valve for adjusting an amount of gas that impinges on a bolt carrier during operation of a firearm.

FIG. 2 illustrates an isometric view of a front portion of an exemplary embodiment of an upper receiver 104 that includes a gas regulator valve 152 for adjusting the amount of gas that impinges on the bolt carrier during operation of the firearm 100. The gas regulator valve 152 includes a gas inlet 156 disposed at a front 160 of the upper receiver 104 and an actuator 164 disposed on a left side 168 of the upper receiver 104. The gas inlet 156 generally receives expanding gases from a fired cartridge by way of a gas tube 172 (see FIG. 4). The actuator 164 is configured to enable a practitioner, such as a shooter, to quickly adjust the amount of gas that is directed to the bolt carrier. As will be appreciated, the position of the actuator 164 on the left side 168 of the upper receiver 104 enables the shooter to make adjustments to the gas regulator valve 152 without having to move the firearm 100 out of a shooting position. It should be understood, however, that the actuator 164 is not limited to being positioned on the left side 168 of the upper receiver 104, but rather the actuator 164 may be disposed in any location of the upper receiver 104 that is enables a practitioner to quickly adjust the amount of the gas directed to the bolt carrier. For example, in some embodiments, the actuator 164 may be disposed vertically on top of the upper receiver 104, without limitation. Further, in some embodiments, the actuator 164 may be disposed at an oblique angle with respect to the top or the side of the upper receiver 104, without limitation.

Figure 3:
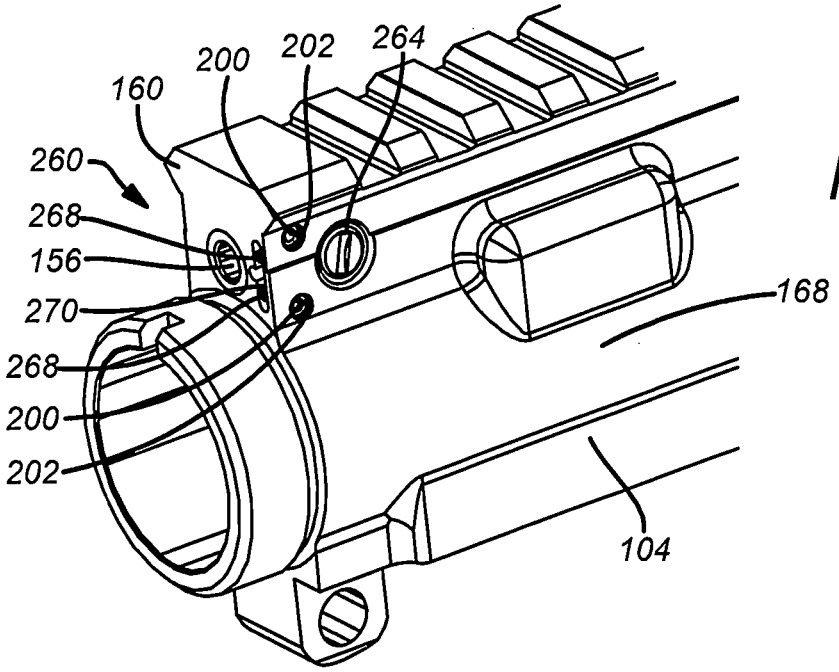
FIG. 3 illustrates an isometric view of a front portion of an exemplary embodiment of an upper receiver that includes a gas regulator valve for adjusting an amount of gas that impinges on a bolt carrier during operation of a firearm.

FIG. 3 illustrates an isometric view of a front portion of an exemplary embodiment of an upper receiver 104 that includes a gas regulator valve 260 for adjusting the amount of gas that impinges on the bolt carrier during operation of the firearm 100. The gas regulator valve 260 is similar to the gas regulator valve 152, shown in FIG. 2. As such, the gas regulator valve 260 includes a gas inlet 156 disposed at a front 160 of the upper receiver 104 and an actuator 264 disposed on a left side 168 of the upper receiver 104. Similar to the actuator 164, the actuator 264 is configured to enable the shooter to quickly adjust the amount of gas that is directed to the bolt carrier without having to move the firearm 100 out of the shooting position. Upon comparing FIG. 2 and FIG. 3, it will be apparent that the actuator 264 shown in FIG. 3 is smaller in diameter than the actuator 164 of FIG. 2. The smaller size of the actuator 264 may facilitate disassembly of the gas regulator valve 260 for servicing and/or cleaning of the upper receiver 104, as described herein.

Figure 4:
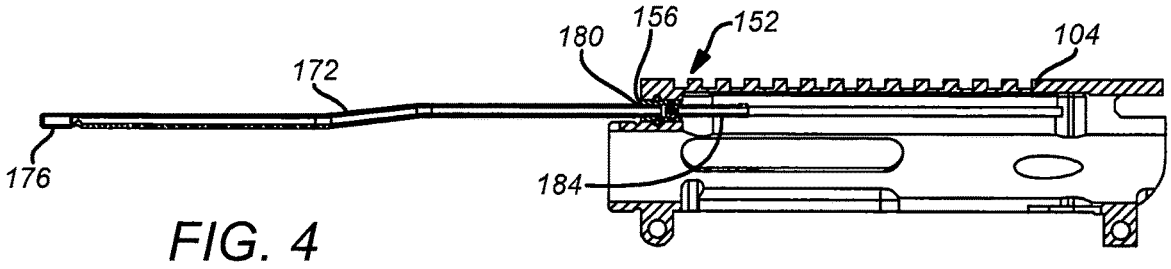
FIG. 4 illustrates a cross-sectional side view of an upper receiver that includes an exemplary embodiment of a gas regulator valve coupled with a gas tube.

Turning, now, to FIG. 4, a cross-sectional view of an upper receiver 104 that includes an exemplary embodiment of a gas regulator valve 152 coupled with a gas tube 172 is illustrated. The gas tube 172 generally includes a distal end 176 and a proximal end 180. The distal end 176 is configured to receive expanding gases from a fired cartridge by way of the front sight base 148 (see FIG. 1). The proximal end 180 is configured to be inserted into the gas inlet 156 distal of the gas regulator valve 152. As shown in FIG. 4, a proximal portion of the gas regulator valve 152 comprises a gas tube 184 that is configured to receive a carrier key (not shown) comprising the bolt carrier. Those skilled in the art will recognize that the gas tube 184 cyclically couples with the carrier key as the expanding gases cause the bolt carrier to move rearward within the buffer tube 124 toward the buttstock 128 (FIG. 1). The gas regulator valve 152 is positioned between the gas tubes 172, 184 and thus enables the shooter to tune the cycle speed of the firearm 100 by adjusting the amount of gas moving through the tubes 172, 184 into the carrier key. The gas regulator valve 152 is described in greater detail herein below.

Figure 5:
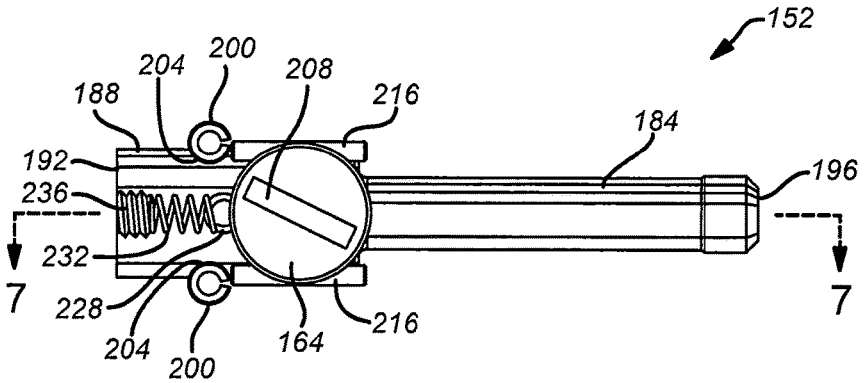
FIG. 5 illustrates a side plan view of an exemplary embodiment of a gas regulator valve in absence of an upper receiver.

FIG. 5 illustrates a side plan view of the gas regulator valve 152 in absence of the upper receiver 104 shown in FIG. 2. The gas regulator valve 152 generally comprises an elongate member that includes a valve body 188 and a gas tube 184. The valve body 188 includes a distal end 192 configured to receive the gas tube 172 (see FIG. 4) while the gas tube 184 includes a proximal end 196 configured to receive the carrier key (not shown) as described herein. The valve body 188 further includes notches 204 (see FIG. 6) that receive lateral pins 200. Once the valve body 188 is installed into the upper receiver 104, as shown in FIG. 2, and the lateral pins 200 are inserted through holes 202 (see FIG. 2) in the upper receiver 104 and extended through the notches 204, the pins 200 and the notches 204 fixate the valve body 188 in the upper receiver 104. Further, the pins 200 and the notches 204 prevent rotation of the valve body 188 within the upper receiver 104.

With continuing reference to FIG. 5, the gas regulator valve 152 includes an actuator 164 that enables the practitioner to adjust the gas flow through the valve 152. The actuator 164 includes a key 208 that may be used to turn the actuator 164 so as to cause a plug 212 (see FIG. 6) to alter the gas flow through the gas tube 184, as described herein. The key 208 may be configured to engage with any of various tools of differing shapes that facilitate rotating the actuator 164, without limitation. For example, in the illustrated embodiment of FIG. 5, the key 208 is configured to receive the rim of an ammunition cartridge. In practice, the practitioner may engage the rim with the key 208 and then turn the actuator 164 to alter the gas flow directed to the bolt carrier, as desired. As such, the illustrated embodiment of the key 208 advantageously enables adjustment of the gas regulator valve 152 without requiring any additional tools or requiring the practitioner to move the firearm 100 out of the shooting position.

Figure 6:
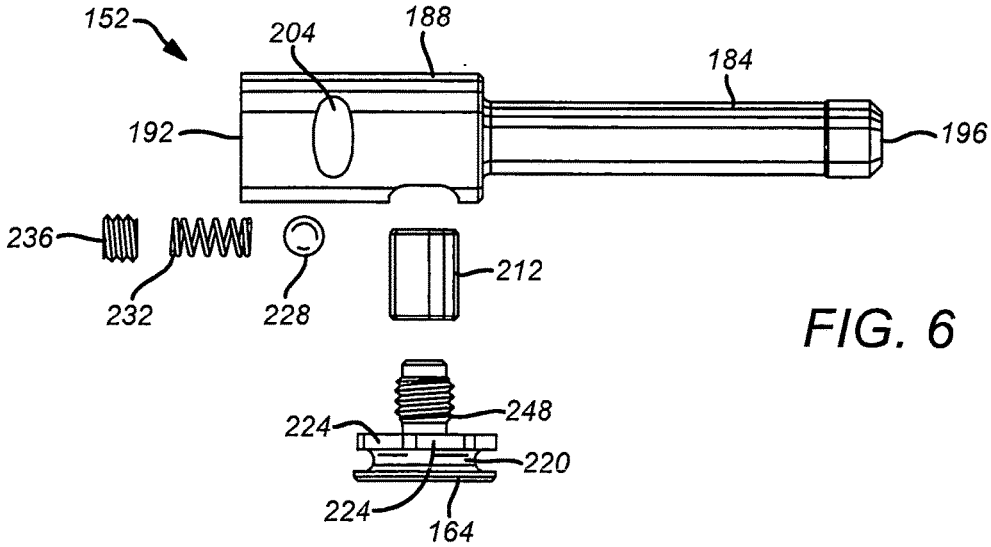
FIG. 6 illustrates an exploded top view of an exemplary embodiment of a gas regulator valve in absence of an upper receiver.

As shown in FIG. 5, the actuator 164 may be supported by longitudinal dowels 216 disposed above and below the actuator 164. The dowels 216 are configured to retain the actuator 164 in the upper receiver 104 while allowing the actuator 164 to be rotated with respect to the upper receiver 104 by the practitioner. As best shown in FIG. 6, the actuator 164 includes a recess 220 that extends around a circumference of the actuator 164. The recess 220 slidably receives the dowels 216 and thus allows the actuator 164 to rotate with respect to the upper receiver 104. Once the actuator 164 is installed into the upper receiver 104, as shown in FIG. 2, and the longitudinal dowels 216 are inserted through holes 222 in the upper receiver 104 and extended through the recess 220, the dowels 216 and the recess 220 retain the actuator 164 in the upper receiver 104. As such, the dowels 216 and the recess 220 allow the actuator 164 to be turned with respect to the upper receiver 104.

With reference to FIG. 6, the actuator 164 includes a plurality of notches 224 that are disposed around the circumference of the actuator 164, adjacent to the recess 220. The notches 224 are arranged to receive a steel ball 228. As shown in FIG. 5, the ball 228 is biased toward the actuator 164 by a spring 232 that is retained in a hole 234 (see FIG. 2) in the upper receiver 104 by a set screw 236. As will be appreciated, the ball and spring 228, 232 serve to fixate the position of the actuator 164 in specific angular positions while allowing the actuator 164 to be rotated with respect to the upper receiver 104. It is contemplated that the ball and spring 228, 232 advantageously provide tactile feedback to the practitioner during rotating the actuator 164 as well as retaining the selected position of the actuator 164.

Figure 7:
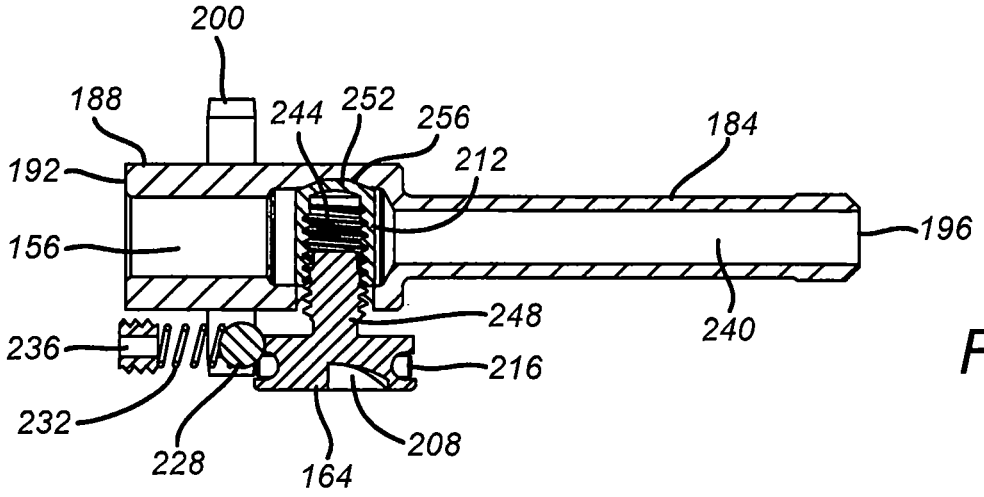
FIG. 7 illustrates a cross-sectional view of the gas regulator valve shown in FIG. 5, taken along a line 7-7.

FIG. 7 illustrates a cross-sectional view of the gas regulator valve 152, shown in FIG. 5, taken along a line 7-7. As described herein, the gas regulator valve 152 generally comprises a valve body 188 and a gas tube 184. The valve body 188 includes a gas inlet 156 that is configured to receive a proximal end 180 of the gas tube 172, as shown in FIG. 4. As will be appreciated, the gas inlet 156 may be configured to form a tightly controlled slip fit with the proximal end 180, so as to minimize gas leakage between the proximal end 180 and the gas inlet 156. Similarly, the gas tube 184 generally is configured to be received into a carrier key comprising the bolt carrier. It is contemplated that the gas tube 184 generally is configured to form a tightly controlled slip fit with the carrier key, such that expanding gases exiting a gas outlet 240 comprising the gas tube 184 do not leak in excess between the carrier key and the proximal end 196 of the gas tube 184.

As shown in FIG. 7, a plug 212 is disposed between the gas inlet 156 and the gas outlet 240. Thus, the flow of expanding gases passing through the gas regulator valve 152 may be regulated by altering the position of the plug 212 within the valve 152. The plug 212 generally is a hollow member having a threaded hole 244 that opens at one end and extends into the plug 212 to a closed end 252. The threaded hole 244 receives a stem 248 comprising the actuator 164 while the closed end 252 is configured to contact a seat 256 inside the valve body 188. The stem 248 includes threads that are configured to mate with the threads comprising the threaded hole 244. Upon the practitioner turning the actuator 164, as described herein, the stem 248 rotates with respect to the threaded hole 244, causing the plug 212 to move with respect to the seat 256. In some embodiments, the threaded hole 244 and the threads of the stem 248 are configured to advance the plug 212 toward the seat 256 when the actuator 164 is turned in a clockwise direction. In some embodiments, however, the threaded hole 244 and the threads of the stem 248 may be configured to advance the plug 212 toward the seat 256 when the actuator 164 is turned counterclockwise. As such, the practitioner may turn the actuator 164 accordingly to increase or decrease the gas flow through the gas regulator valve 152, thereby enabling the practitioner to adjust the cycle speed of the bolt carrier during firing the firearm 100.

Figure 8:
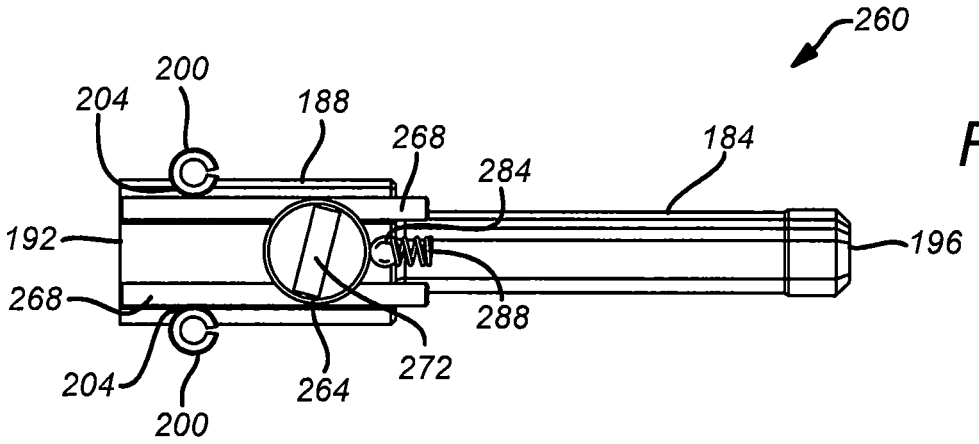
FIG. 8 illustrates a side plan view of an exemplary embodiment of a gas regulator valve in absence of an upper receiver.
Figure 9:
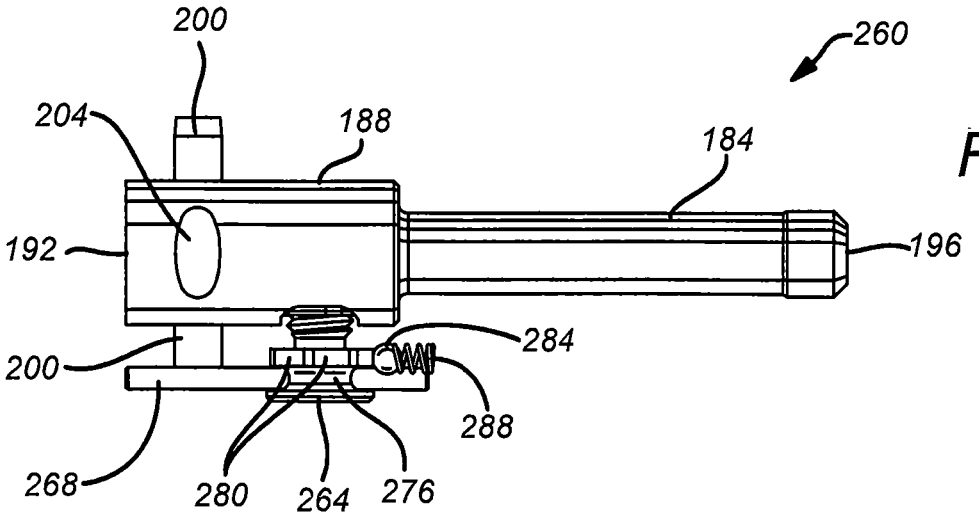
FIG. 9 illustrates a top view of an exemplary embodiment of a gas regulator valve in absence of an upper receiver.

FIGS. 8-9 illustrate an exemplary embodiment of a gas regulator valve 260 for adjusting the amount of gas that impinges on the bolt carrier during operation of the firearm 100. The gas regulator valve 260 illustrated in FIGS. 8-9 is substantially similar to the gas regulator valve 152, shown in FIGS. 5-7, with an exception being that the gas regulator valve 260 includes an actuator 264 having a smaller diameter than the actuator 164 comprising the gas regulator valve 152. As will be recognized, upon comparing FIGS. 8-9 with FIGS. 5-6, the relatively small diameter of the actuator 264 facilitates utilizing longer longitudinal dowels 268 to retain the actuator 264 in the upper receiver 104. As best shown in FIG. 8, the diameter of the actuator 264 provides enough clearance between lateral dowels 200, retaining the valve body 188 in the upper receiver 104, to allow the longitudinal dowels 268 to extend from a distal end 192 of the valve body 188, along the length of the valve body 188, to the gas tube 184. It is contemplated that the longer longitudinal dowels 268 simplify their removal during servicing and/or cleaning of the upper receiver 104. To this end, as shown in FIG. 3, a counterbore 270 may be disposed in the front 160 of the upper receiver 104 around the longitudinal dowels 268. The counterbore 270 generally provides clearance for a suitable tool, such as pliers, to grip and remove the longitudinal dowels 268 during disassembly of the gas regulator valve 260.

Turning, again, to FIGS. 8-9, the actuator 264 generally enables the practitioner to adjust the gas flow through the gas regulator valve 260. The actuator 264 includes a key 272 that may be rotated to cause a plug 212 (see, for example, FIG. 6) to alter the gas flow through the gas tube 184 and into the bolt carrier, as described herein. The key 272 may be implemented with any of various shapes to engage with a suitable tool that facilitates rotating the actuator 264. Similar to the key 208, shown in FIG. 5, the illustrated embodiment of the key 272 is configured to receive the rim of an ammunition cartridge. As such, the practitioner may engage the rim with the key 272 and then turn the actuator 264 to alter the gas flow directed to the bolt carrier, as described herein. It is contemplated that the key 272 advantageously enables adjustment of the gas regulator valve 260 without requiring any additional tools or requiring the practitioner to move the firearm 100 out of the shooting position.

As best shown in FIG. 8, the longitudinal dowels 268 are disposed above and below the actuator 264. As such, the dowels 268 retain the actuator 264 in the upper receiver 104 while allowing the actuator 264 to be turned with respect to the upper receiver 104 by the practitioner. As best shown in FIG. 9, the actuator 264 includes a recess 276 that extends around a circumference of the actuator 264. The recess 276 receives the dowels 268 and allows the actuator 264 to be rotated with respect to the upper receiver 104. Once the actuator 264 is installed into the upper receiver 104 (see FIG. 3), and the longitudinal dowels 268 are inserted through holes (not shown) in the upper receiver 104 and extended through the recess 276, the dowels 268 retain the actuator 264 in the upper receiver 104. As such, the dowels 268 and the recess 276 allow the actuator 264 to rotate within the upper receiver 104.

As shown in FIG. 9, a plurality of notches 280 are disposed around the circumference of the actuator 264, adjacent to the recess 276. The notches 280 are arranged to receive a steel ball 284 that is biased toward the actuator 264 by a spring 288. In general, the ball 284 and the spring 288 allow the actuator 264 to be rotated among specific angular positions with respect to the upper receiver 104. Further, it is contemplated that the ball and spring 284, 288 provide tactile feedback to the practitioner during rotating the actuator 264 to adjust the gas flow to the bolt carrier of the firearm 100.

In the embodiment illustrated in FIG. 9, the ball 284 and the spring 288 are retained in the upper receiver 104 by the actuator 264. Upon comparing the embodiments of FIGS. 5 and 9, it will be recognized that retaining the ball 284 and the spring 288 by way of the actuator 264 advantageously obviates the set screw 236, shown in FIG. 5. As such, the gas regulator valve 260 of FIG. 9 eliminates a need for tapping a threaded hole into the front 160 (see FIG. 3) of the upper receiver 104 and thus provides a simpler installation than the gas regulator valve 152 of FIG. 5.

It should be borne in mind that the gas regulator valves 152, 260 are not to be limited to specific configurations shown and discussed in connection with FIGS. 5-9. For example, in some embodiments, the gas regulator valve may include an actuator and a plug comprising a single component that is rotationally mounted within the valve body such that various degrees of actuator rotation correspond to various degrees of valve body occlusion. Further, in some embodiments, multiple ports of differing sizes may be incorporated into the plug such that the actuator can be rotationally positioned to direct gas flow through one or more of the ports and thus affect the valve body occlusion.

Figure 10:
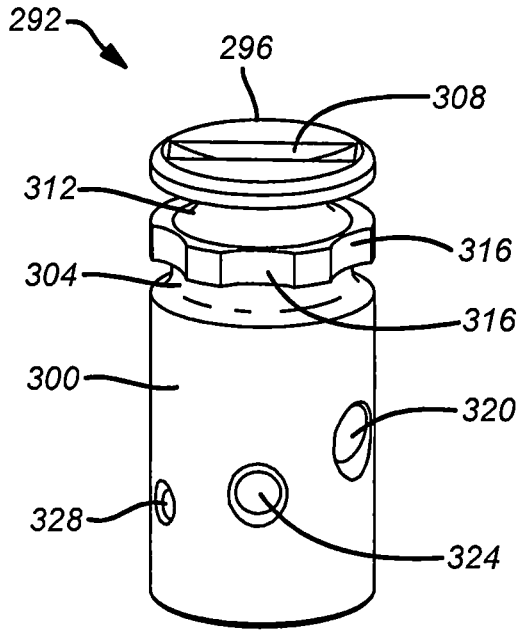
FIG. 10 illustrates an isometric view of an exemplary embodiment of a multi-port actuator for providing various degrees of valve occlusion.
Figure 11:
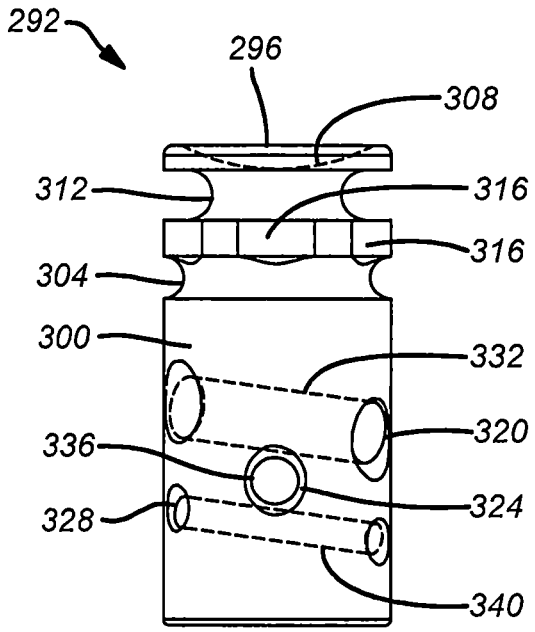
FIG. 11 is a side ghost-view of the multi-port actuator of FIG. 10, illustrating a first port, a second port, and a third port that extend through the multi-port actuator.

FIGS. 10-11 illustrate an exemplary embodiment of a multi-port actuator 292 that includes multiple ports for providing various degrees of valve occlusion. The multi-port actuator 292 comprises an actuator 296 and a plug 300 that are joined by a stem 304. As such, the multi-port actuator 292 generally is a monolithic component that may be rotationally mounted within a suitable valve body, such as the valve body 188 discussed hereinabove, and configured to be turned by a practitioner similarly to a ball valve, as described herein. It is contemplated that, in some embodiments, the multi-port actuator 292 may be disposed horizontally on a side of the upper receiver 104, as described herein. In some embodiments, however, the multi-port actuator 292 may be disposed vertically on a top of the upper receiver 104, without limitation.

The actuator 296 generally enables the practitioner to adjust the gas flow through a gas regulator valve, such as the gas regulator valve 260 shown in FIGS. 8-9. As shown in FIGS. 10-11, the actuator 296 includes a key 308 that may be rotated to cause the plug 300 to rotate within the valve body 188 and thus alter the gas flow through the gas regulator valve 260, as described herein. The key 308 may be implemented with any of various shapes to engage with a suitable tool that facilitates rotating the multi-port actuator 292. Similar to the keys described hereinabove, the key 308 is configured to receive the rim of an ammunition cartridge. As such, the practitioner may engage the rim with the key 308 and then turn the multi-port actuator 292 to alter the gas flow directed to the bolt carrier, as described herein. The key 308 advantageously enables adjustment of the gas regulator valve 260 without requiring any additional tools or requiring the practitioner to move the firearm 100 out of the shooting position.

The actuator 296 shown in FIGS. 10-11 includes a recess 312 and multiple notches 316 arranged adjacent to the recess 312. The recess 312 extends around a circumference of the actuator 296 and is configured to receive dowels 268 (see FIGS. 8-9) that allow the multi-port actuator 292 to be rotated with respect to the valve body 188. The dowels 268 retain the multi-port actuator 292 in the valve body 188; and as such, the dowels 268 and the recess 312 allow the multi-port actuator 292 to rotate within the upper receiver 104. Further, the notches 316 are aligned with ports disposed in the plug 300 and are configured to receive a steel ball 284 (see FIGS. 8-9) that is biased toward the multi-port actuator 292 by a spring 288. In general, the notches 316, and the ball 284 and spring 288, allow the multi-port actuator 292 to be rotated among specific angular positions that direct gas flow through ports having different sizes and thus affect the degree of occlusion provided by the valve body 188.

With continuing reference to FIGS. 10-11, the illustrated embodiment of the plug 300 includes a first port 320, a second port 324, and a third port 328 that are each aligned with one of the notches 316. As best shown in FIG. 11, the first port 320 comprise a first hole 332 that extends through the plug 300, the second port 324 comprises a second hole 336 that extends through the plug 300 without intersecting the first hole 332, and the third port 328 comprises a third hole 340 that extends through the plug 300 without intersecting the second hole 336. In the illustrated embodiment, the first, second, and third holes 332, 336, 340 have different diameters. For example, the first hole 332 has a diameter that is greater that the diameter of the second hole 336 while the second hole 336 has a diameter that is greater than the diameter of the third hole 340. Further, the notches 316 are configured to each align one of the first, second, and third holes 332, 336, 340 with the gas flow through the valve body 188. As such, the actuator 296 may be rotated among the notches 316 to select different gas flows provided by the first, second, and third holes 332, 336, 340.

Figure 12:
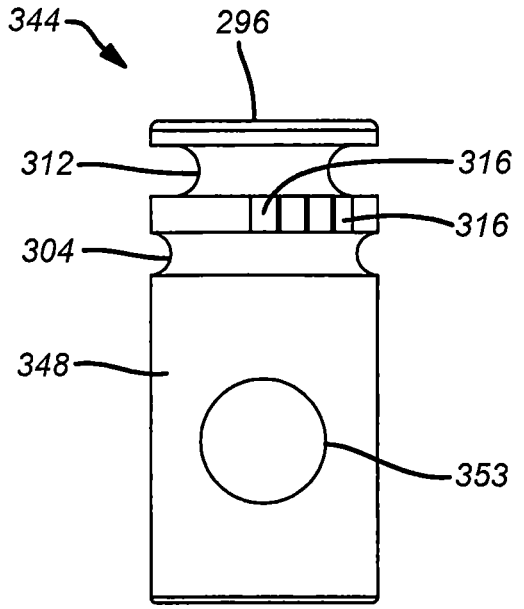
FIG. 12 illustrates a side, downstream view of an exemplary embodiment of a single-port actuator that provides various degrees of valve occlusion.
Figure 13:
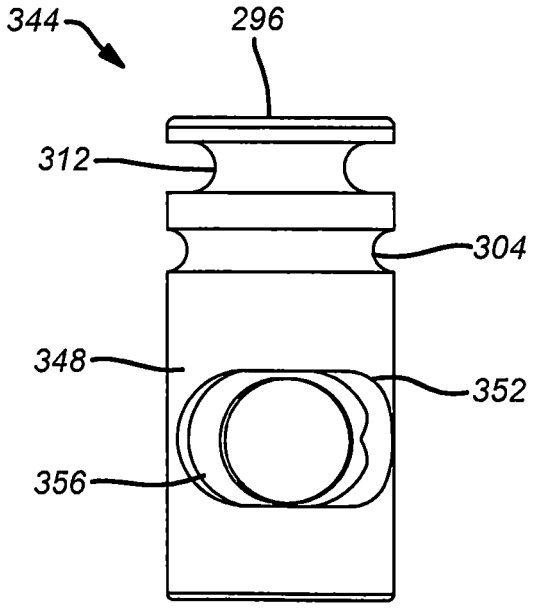
FIG. 13 illustrates a side, upstream view of the single-port actuator of FIG. 12.

Turning, now, to FIGS. 12-13, an exemplary embodiment of a single-port actuator 344 that provides various degrees of valve occlusion is shown. The single-port actuator 344 is substantially similar to the multi-port actuator 292, shown in FIGS. 10-11, with the exception that the single-port actuator 344 includes a plug 348 that has a single port 352, in lieu of the first, second, and third ports 320, 324, 328 shown in FIGS. 10-11. The single-port actuator 344 is a monolithic component that comprises a stem 304 that joins an actuator 296 and the plug 348. The single-port actuator 344 may be rotationally mounted within a suitable valve body, such as the valve body 188, discussed hereinabove, and configured to be turned by the practitioner similarly to a ball valve. In some embodiments, the single-port actuator 344 may be disposed horizontally on a side of the upper receiver 104 or may be disposed vertically on top of the upper receiver 104, without limitation.

As shown in FIG. 12, the port 352 comprises a substantially circular cross-sectional shape 353 on a downstream side of the single-port actuator 344. On an upstream side of the single-port actuator 344, shown in FIG. 13, the port 352 is relatively larger and includes an interior surface 356. The size and shape of the interior surface 356 generally are configured to provide an unobstructed gas flow from the gas inlet 156 (see FIG. 7) through the plug 348 to the port 353, such that valve occlusion only arises due to the valve body 188 blocking a portion of the port 353. As best shown in FIG. 12, notches 316 are disposed adjacent to the recess 312 at positions of the plug 348 that cause specific portions of the port 353 to be blocked within the valve body 188. As will be appreciated, therefore, the single-pot actuator 344 may be rotated among the notches 316 to select desired gas flows provided by gas flow through the unblocked portions of port 353.

Figure 14:
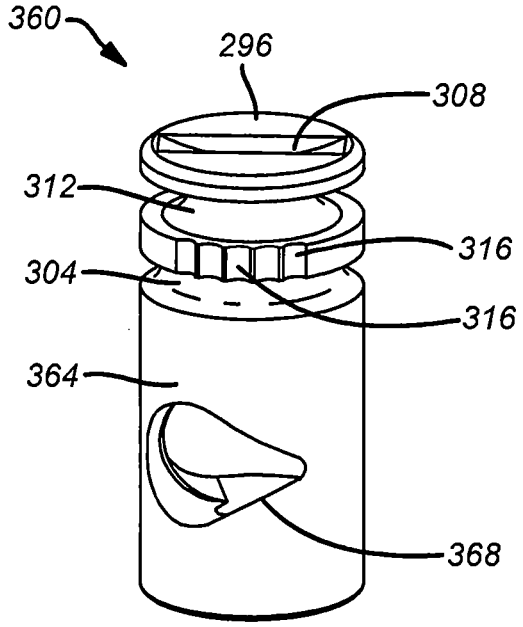
FIG. 14 illustrates an isometric view of a downstream side of an exemplary embodiment of a variable cross-section actuator that is configured to provide various degrees of valve occlusion.
Figure 15:
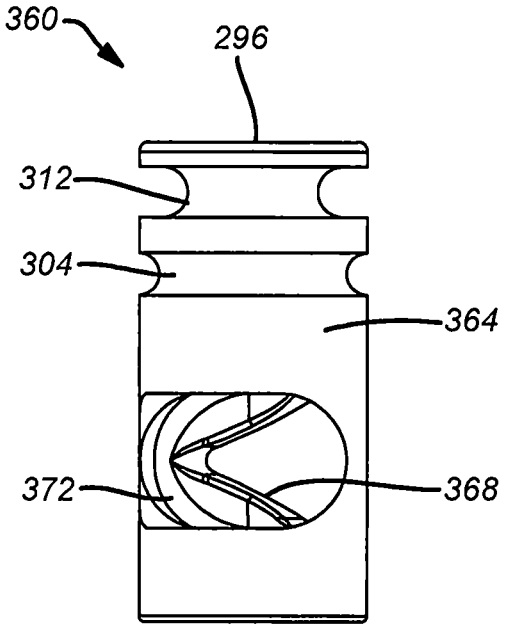
FIG. 15 illustrates a side view of an upstream side of the variable cross-section actuator of FIG. 14.

FIGS. 14-15 illustrate an exemplary embodiment of a variable cross-section actuator 360 that is configured to provide various degrees of valve occlusion. The variable cross-section actuator 360 is substantially similar to the single-port actuator 344, shown in FIGS. 12-13, with the exception that the variable cross-section actuator 360 includes a plug 364 that has a teardrop port 368, in lieu of the circular port 353 shown in FIG. 12. Similar to the single-port actuator 344, the variable cross-section actuator 360 is a monolithic component that comprises a stem 304 joining an actuator 296 and the plug 364. As such, the variable cross-section actuator 360 may be rotationally mounted within a suitable valve body, such as the valve body 188, and configured to be turned by the practitioner similarly to a ball valve. Further, the variable cross-section actuator 360 may be disposed either horizontally on a side of the upper receiver 104 or vertically on top of the upper receiver 104, as described herein.

As shown in FIG. 14, a downstream side of the variable cross-section actuator 360 includes the teardrop port 368 while on an upstream side of the variable cross-section actuator 360, the port 368 is relatively larger and includes an interior surface 372. The size and shape of the interior surface 372 are configured to provide an unobstructed gas flow from the gas inlet 156 (see FIG. 7) through the plug 364 to the teardrop port 368, such that valve occlusion only arises due to the valve body 188 blocking a portion of the teardrop port 368. As shown in FIG. 14, notches 316 are disposed at positions with respect to the plug 364 that cause specific portions of the teardrop port 368 to be blocked within the valve body 188. As such, the variable cross-section actuator 360 may be rotated among the notches 316 to select different gas flows provided by unblocked portions of the teardrop port 368.

Figure 16:
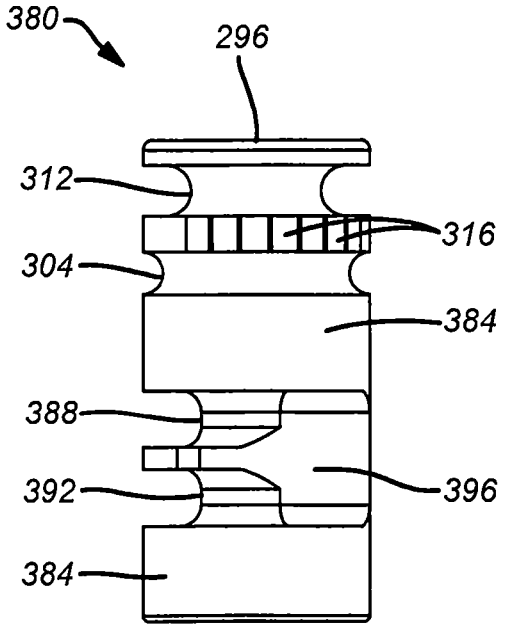
FIG. 16 illustrates a first side view of an exemplary embodiment of a slotted actuator that is configured to provide various degrees of valve occlusion.
Figure 17:
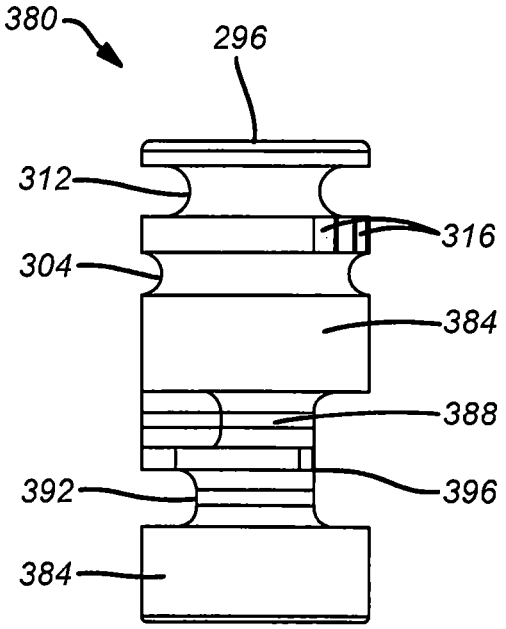
FIG. 17 illustrates a second side view of the slotted actuator shown in FIG. 16.
Figure 17A:
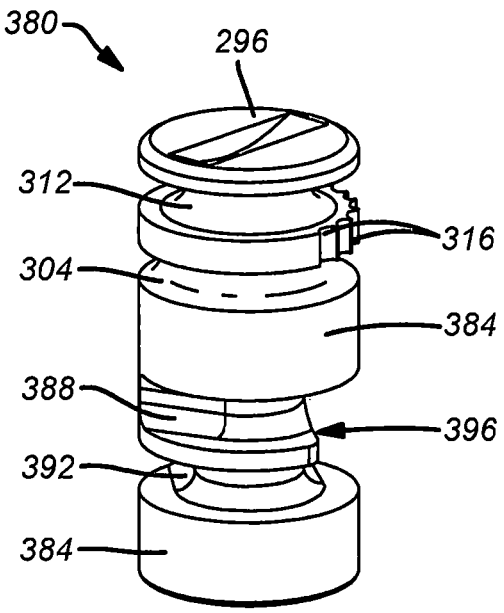
FIG. 17A illustrates an isometric view of the slotted actuator shown in FIGS. 16-17.

FIGS. 16-17A illustrate an exemplary embodiment of a slotted actuator 380 that is configured to provide various degrees of valve occlusion. The slotted actuator 380 is similar to the variable cross-section actuator 360, shown in FIGS. 14-15, with the exception that the slotted actuator 380 comprises a plug 384 that includes a first slot 388, a second slot 392, and a third slot 396, in lieu of the plug 364 that includes the port 368, shown in FIGS. 14-15. In general, the first, second, and third slots 388, 392, 396 may have different lengths, cross-sectional areas, angular arrangements around a circumference of the plug 384, and the like, such that different rotational positions of the plug 384 within the valve body 188 provide differing degrees of valve occlusion as the slots 388, 392, 396 become aligned or misaligned with ports or slots comprising the valve body 188. For example, in the illustrated embodiment, the first and second slots 388, 392 have similar cross-sectional areas while the third slot 396 has a larger cross-sectional area. Further, the second slot 392 extends farther around the circumference of the plug 384 than the first and third slots 388, 396. Thus, the plug 384 can be rotated with respect to the valve body 188 to direct gas flow through one or more of the first, second, and third slots 388, 392, 396 so as to provide different degrees of valve occlusion. Further, the slotted actuator 380 can be rotated among the notches 316 to select different gas flows provided by the first, second, and third slots 388, 392, 396.

Figure 18:
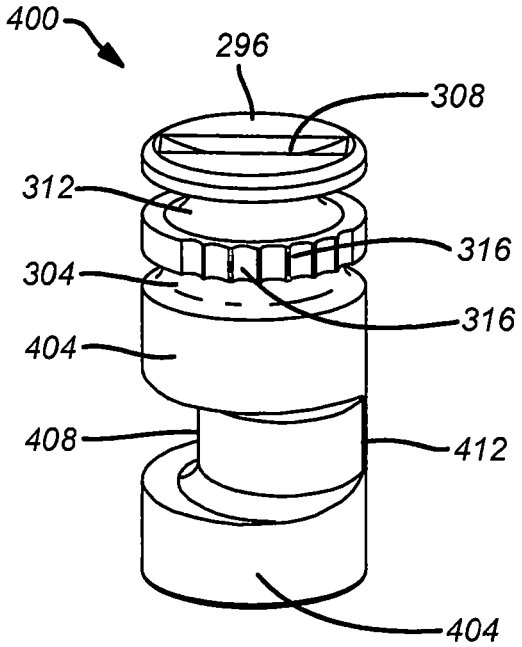
FIG. 18 illustrates an isometric view of an exemplary embodiment of an eccentric actuator that is configured to provide various degrees of valve occlusion.
Figure 19:
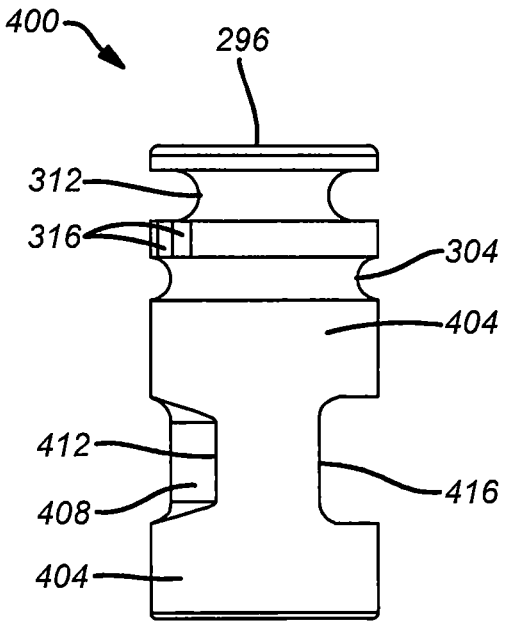
FIG. 19 is a first side view of the eccentric actuator shown in FIG. 18, illustrating a slot start and a slot end comprising the eccentric actuator.
Figure 20:
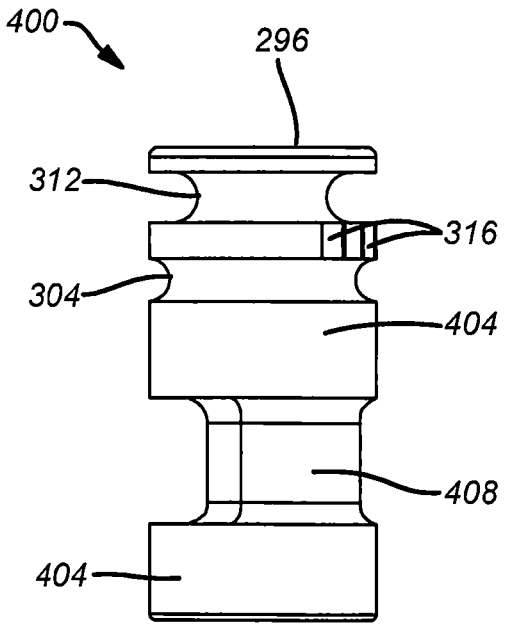
FIG. 20 is a second side view of the eccentric actuator shown in FIG. 19.

FIGS. 18-20 illustrate an exemplary embodiment of an eccentric actuator 400 that is configured to provide various degrees of valve occlusion. The eccentric actuator 400 is similar to the slotted actuator 380, shown in FIGS. 16-17A, with the exception that the eccentric actuator 400 comprises a plug 404 that includes an eccentric slot 408, in lieu of the first, second, and third slots 388, 392, 396 comprising the slotted actuator 380 of FIGS. 16-17A. As best shown in FIG. 19, the eccentric slot 408 begins at a slot start 412, characterized by a minimal cross-sectional area, extends around the circumference of the plug 404, and terminates at a slot end 416 that is characterized by a maximal cross-sectional area. The cross-sectional area of the eccentric slot 408 generally increases around the circumference of the plug 404. As shown in FIG. 18, notches 316 are disposed with respect to the plug 404 so as to align specific portions of the eccentric slot 408 with the gas inlet 156 (see FIG. 7). Thus, the eccentric actuator 400 can be rotated among the notches 316 to select desired degrees of valve occlusion provided by directing gas flow from the gas inlet 156 (see FIG. 7), through the portion of the eccentric slot 408 that is aligned with the gas inlet 156, and into the gas outlet 240 (see FIG. 7).

While the adjustable gas regulator valve and methods have been described in terms of particular variations and illustrative figures, those of ordinary skill in the art will recognize that the adjustable gas regulator valve is not limited to the variations or figures described. In addition, where methods and steps described above indicate certain events occurring in certain order, those of ordinary skill in the art will recognize that the ordering of certain steps may be modified and that such modifications are in accordance with the variations of the gas regulator valve. Additionally, certain of the steps may be performed concurrently in a parallel process, when possible, as well as performed sequentially as described above. To the extent there are variations of the gas regulator valve, which are within the spirit of the disclosure or equivalent to the gas regulator valve found in the claims, it is the intent that this patent will cover those variations as well. Therefore, the present disclosure is to be understood as not limited by the specific embodiments described herein, but only by scope of the appended claims.

What is claimed is:

1. A gas regulator valve for adjusting cycle speed of a bolt carrier of a firearm, comprising:

a valve body for providing a gas inlet;

a gas tube for receiving a carrier key of the bolt carrier;

a plug for controlling gas flow through the gas tube wherein the plug includes a threaded hole extending through the plug from an open end to a closed end configured to contact a seat inside the valve body;

an actuator configured for altering the position of the plug;

a stem disposed between the plug and the actuator, wherein the stem includes threads threadably engaged within the threaded hole;

a plurality of notches disposed around the circumference of the actuator;

a ball biased toward the notches by a spring, wherein the ball and the spring fixate the actuator in specific angular positions; and a recess disposed between the actuator and the stem, wherein the recess is configured to receive at least one dowel to retain the actuator in a valve body.

2. The gas regulator valve of claim 1, wherein the gas inlet is disposed in a distal end of the valve body and is configured to receive a gas tube comprising the firearm.

3. The gas regulator valve of claim 1, wherein the plug is disposed between the gas inlet and a gas outlet comprising the gas tube.

4. The gas regulator valve of claim 1, wherein the gas flow may be controlled by turning the actuator to alter the position of the plug within the valve body.

5. The gas regulator valve of claim 1, wherein the threaded hole and the threads of the stem are configured to cooperate to cause the plug to move with respect to a seat when the actuator is turned.

6. The gas regulator valve of claim 5, wherein the threaded hole and the threads of the stem are configured to advance the plug toward the seat when the actuator is turned in a clockwise direction.

7. The gas regulator valve of claim 5, wherein the threaded hole and the threads of the stem are configured to advance the plug toward the seat when the actuator is turned counterclockwise.

8. An upper receiver for a direct gas impingement operated firearm, comprising:

a gas inlet for receiving expanding gases from a fired cartridge;

a gas tube for directing the expanding gases to a bolt carrier;

a plug for controlling gas flow through the gas tube wherein the plug includes a threaded hole extending through the plug from an open end to a closed end configured to contact a seat inside the valve body;

an actuator for controlling flow of the expanding gases to the bolt carrier via rotation;

a stem disposed between the plug and the actuator, wherein the stem threadably engages within the threaded hole;

a plurality of notches disposed around the circumference of the actuator;

a ball biased toward the notches by a spring, wherein the ball and the spring fixate the actuator in specific angular positions; and a recess disposed between the actuator and the stem, wherein the recess is configured to receive at least one dowel for retaining the actuator within the upper receiver.

9. The upper receiver of claim 8, wherein the gas inlet is disposed at the front of the upper receiver and is configured to receive the expanding gases by way of a front sight base and a gas tube comprising the firearm.

10. The upper receiver of claim 8, wherein the gas tube is configured to receive a carrier key comprising the bolt carrier.

11. The upper receiver of claim 8, wherein the actuator is positioned on the upper receiver to enable a practitioner to adjust the flow of expanding gases without moving the firearm out of a shooting position.

12. The upper receiver of claim 8, wherein the actuator includes a key that is configured to receive a tool to enable rotation of the actuator.

13. The upper receiver of claim 12, wherein the key is configured to receive the rim of an ammunition cartridge.

* * * * *